US006450612B2

(12) United States Patent
Igarashi et al.

(10) Patent No.: US 6,450,612 B2
(45) Date of Patent: Sep. 17, 2002

(54) RECORDING HEAD POSITION ADJUSTING MECHANISM IN INK JET RECORDING APPARATUS

(75) Inventors: Hitoshi Igarashi; Masanori Yoshida, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/884,004

(22) Filed: Jun. 19, 2001

Related U.S. Application Data

(63) Continuation of application No. 08/911,157, filed on Aug. 14, 1997, now Pat. No. 6,270,184.

(30) Foreign Application Priority Data

Aug. 14, 1996 (JP) ..... 8-233589
Jul. 17, 1997 (JP) ..... 9-208695

(51) Int. Cl.[7] ..... B41J 23/00
(52) U.S. Cl. ..... 347/37; 347/8
(58) Field of Search ..... 347/37, 8, 40.44, 347/43.49; 400/55–60

(56) References Cited

U.S. PATENT DOCUMENTS 4,776,715 A 10/1988 Takada et al. ..... 400/323
4,990,938 A 2/1991 Branden et al. ..... 347/44
5,000,590 A 3/1991 Einem ..... 400/55
5,359,355 A 10/1994 Nagdhi et al. ..... 347/9
5,696,541 A * 12/1997 Akahane et al. ..... 347/8
5,880,751 A 3/1999 Ta ..... 347/40
6,270,184 B1 * 8/2001 Igarashi et al. ..... 347/37

FOREIGN PATENT DOCUMENTS

| | | |
|---|---|---|
| DE | 37 37 499 | 5/1989 |
| DE | 195 11 416 | 11/1995 |
| EP | 0 540 987 | 5/1993 |
| EP | 0 678 393 | 10/1995 |
| JP | 2 155 781 | 6/1990 |
| JP | 3 162 982 | 7/1991 |
| JP | 7-314851 | 3/1995 |
| JP | 8 108 593 | 4/1996 |

* cited by examiner

*Primary Examiner*—John Barlow
*Assistant Examiner*—Shih-wen Hsieh
(74) *Attorney, Agent, or Firm*—Stroock & Stroock & Lavan LLP

(57) ABSTRACT

A head position adjustment mechanism includes two plates mounted so as to be displaceable in a scanning direction and in a sheet feed direction. The two plates can be adjusted independently in a scanning direction by angle adjusting levers that pivot the plates about reference pins. At least one plate can be adjusted in the sheet feed direction by a nozzle positioning adjusting lever that actuates a cam positioned to urge the plate in the sheet feed direction while the plate is guided by a reference pin.

7 Claims, 4 Drawing Sheets

RECORDING HEAD POSITION ADJUSTING MECHANISM IN INK JET RECORDING APPARATUS

CROSS-REFERENCE TO RELATED APPLICATIONS

This application is a continuation of application Ser. No. 08/911,157, filed Aug. 14, 1997, now patented, U.S. Pat. No. 6,270,184 B1 on Aug. 7, 2001.

BACKGROUND OF THE INVENTION

This invention relates to a recording head position adjusting mechanism in an ink jet recording apparatus.

If a black recording head and a color recording head are mounted on a single carriage in order to compose a color printer using a serial type on-demand ink jet recording apparatus, the mechanical tolerances and mounting tolerances inherent in the respective recording heads cause relative positioning errors, and these errors cannot form satisfactory color images.

To overcome this problem, a mechanism disclosed in Japanese Patent Publication No. Hei. 7-314851 was considered. This mechanism not only corrects an inclination of each recording head independently by interposing a rotary correcting plate in either one of scanning directions on a contact surface extending in parallel to the scanning directions, but also adjusts a sheet feed direction in one of the recording head based upon the other recording head by interposing an adjusting plate on either one of positioning surfaces extending in parallel to the scanning directions. This mechanism provides the advantage that the inclination adjustment as well as the position adjustment in the sheet feed direction of the recording heads can be made simultaneously. However, these adjustments require that a plurality of rotary correcting plates and adjusting plates whose thicknesses are different according to amount of correction required. Also, such adjustments are likely to cause slight recording head positioning errors during the process of inserting correcting plates and adjusting plates. Accordingly, it is desired to provide a recording head positioning mechanism which overcomes the shortcomings of the prior art.

SUMMARY OF THE INVENTION

This invention has been made in view of such problems. An object of the invention is, therefore, to provide a novel recording head position adjusting mechanism capable of correctly adjusting the inclination of a recording head by simply turning a lever disposed on a carriage.

Further, another object of the invention is to provide a novel recording head position adjusting mechanism capable of adjusting the position of one of the recording heads in a sheet feed direction relative to the other recording head by simply turning a lever disposed on the carriage.

According to a first aspect of the invention, there is provided a recording head position adjusting mechanism in an ink jet recording apparatus, wherein a carrying body, formed as a board, carrying a recording head is constructed and arranged so as to be pivotable about a reference pin as a fulcrum on the carriage in a scanning direction. The carrying body also includes an angle adjusting member arranged on the carriage at a distant position from the pin that includes a cam surface which displaces the carrying body in the scanning direction by contacting the carrying body.

According to a second aspect of the invention, there is provided a recording head position adjusting mechanism in an ink jet recording apparatus, wherein two carrying bodies each carrying a recording head are arranged on a carriage, and one carrying body is displaced in a sheet feed direction with respect to the other carrying body, comprising: a nozzle position adjusting member arranged on the carriage, which displaces one of the two carrying bodies in a sheet feed direction by contacting one of the two carrying bodies.

According to a third aspect of the invention, there is provided a recording head position adjusting mechanism in an ink jet recording apparatus, wherein two carrying bodies each carrying a recording head are arranged on a carriage, comprising: two pins arranged on the carriage, the carrying bodies being pivotable and slidable on the pins; two angle adjusting members arranged on the carriage, each having a cam surface for displacing a respective carrying body in a scanning direction by contacting the carrying body; and a nozzle position adjusting member arranged on the carriage, the nozzle position adjusting member displacing one of the two carrying bodies in a sheet feed direction by contacting the carrying body.

Still other objects and advantages of the invention will in part be obvious and will in part be apparent from the specification.

The invention accordingly comprises the features of construction, combination of elements, and arrangement of parts exemplified in the construction hereinafter set forth. The scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

An embodiment of the invention will now be described below.

The respective drawings show an embodiment of the invention applied to a color ink jet recording apparatus that has replaceable ink cartridges. The general construction of this embodiment will be described first with reference to FIG. 1.

Figure 1:
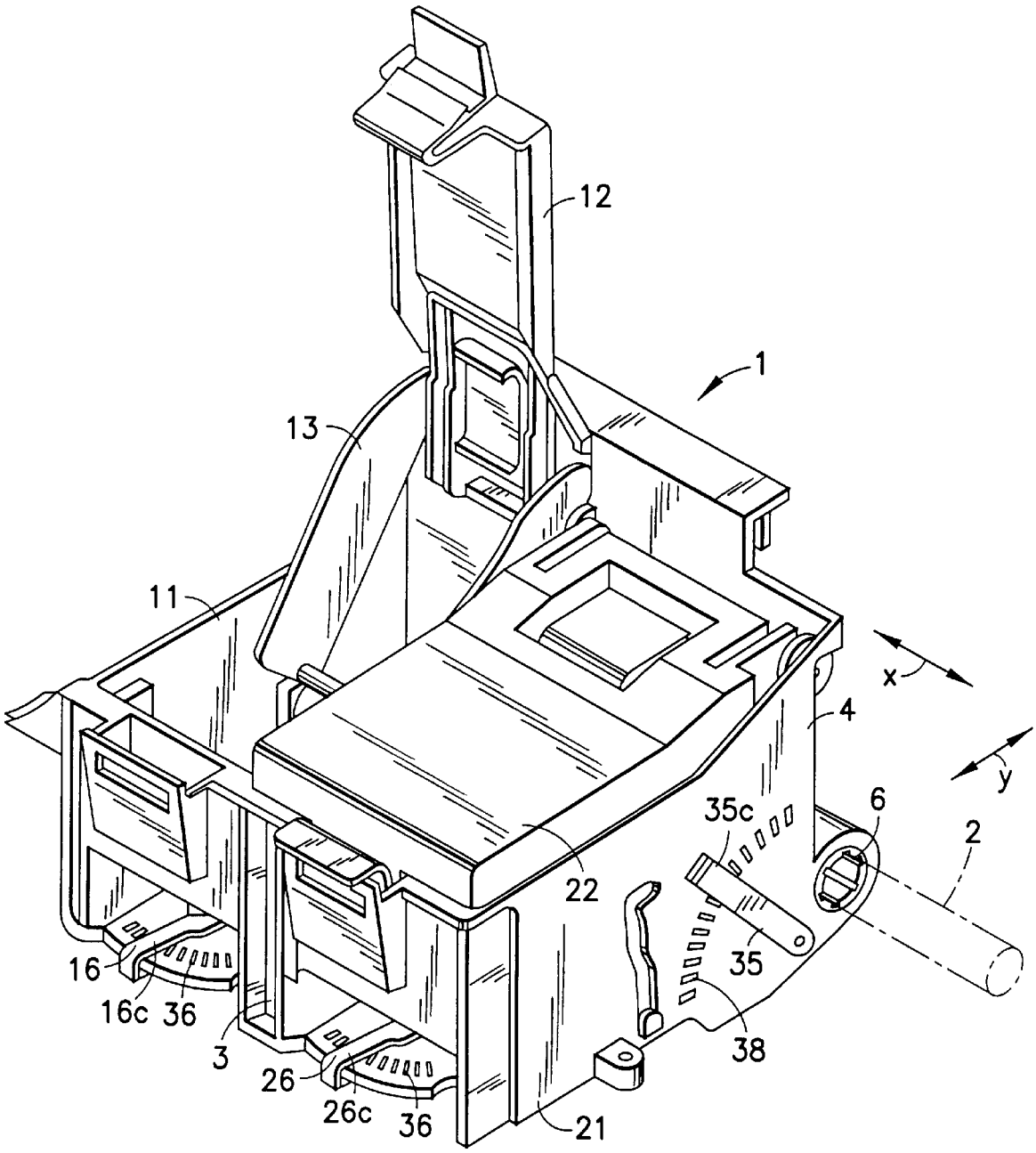
FIG. 1 is a perspective view illustrating a first embodiment of a recording head adjustment mechanism in accordance with the present invention.
Figure 3:
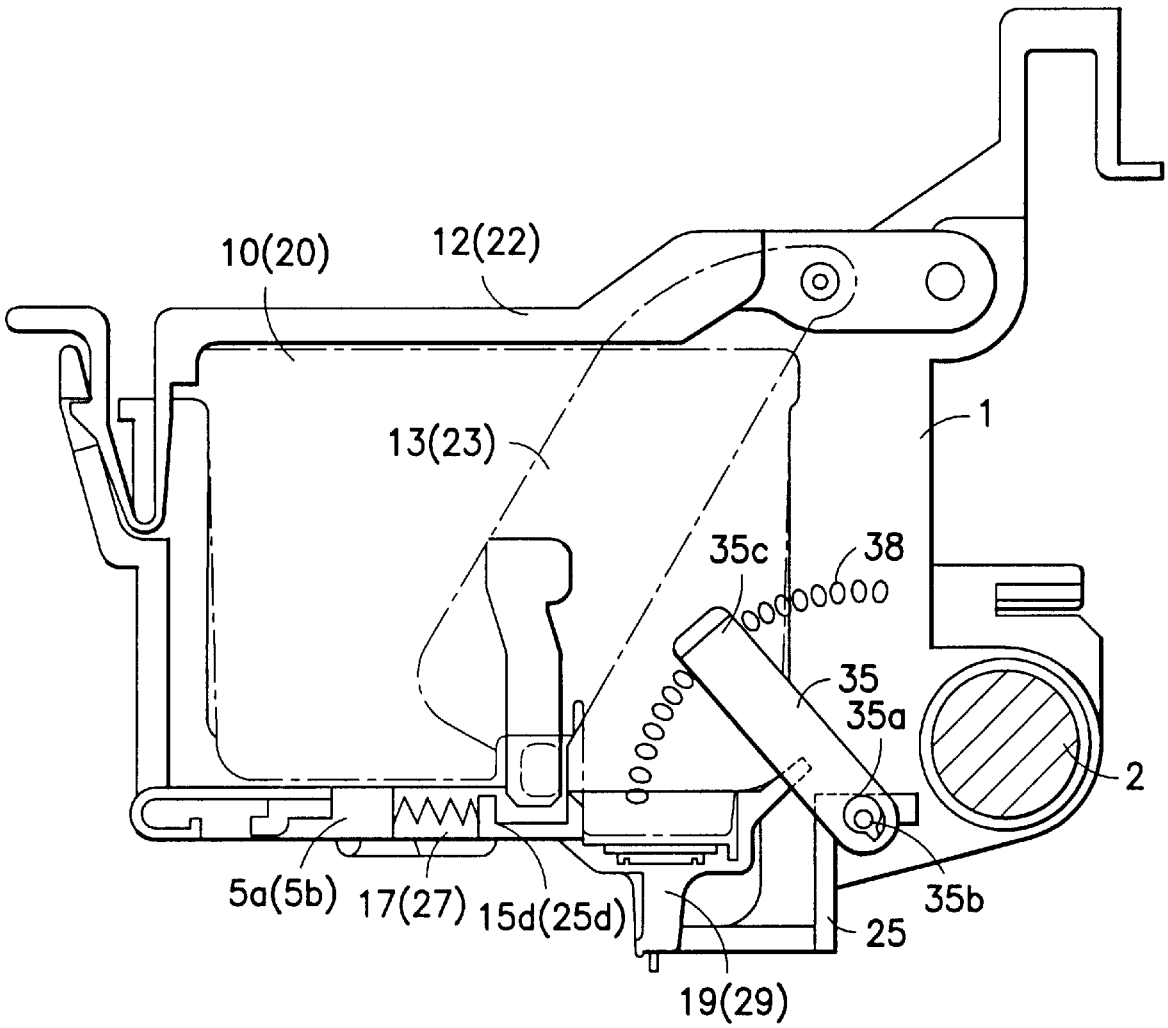
FIG. 3 is a side elevational view, partly cut away, of the recording head adjustment mechanism of FIG. 1.

In FIG. 1, reference numeral 1 denotes a carriage main body that reciprocally shuttles along a guide rod 2 in a main scanning direction, X. Two cartridge. accommodating chambers 11, 21 that respectively accommodate a black ink cartridge 10 and a color ink cartridge 20 (FIG. 3) are formed in carriage main body 1 separated by a partition wall 3. Each chamber is selectively opened or closed by a respective cover 12, 22 mounted to carriage man body 1. FIG. 1 depicts chamber 11 in the open position and chamber 21 in the closed position. It is understood that chamber 21 is constructed in a manner like chamber 11. Cartridge accommodating chambers 11, 21 have lifters 13, 23 for lifting out spent ink cartridges 10, 20 and coupling new ink cartridges 10, 20 to recording heads 19, 29 by interlocking with ink cartridge within chambers 11, 21 and moving the ink cartridges with the opening and closing of covers 12, 22.

A board 5 is formed in carriage main body 1. Angle adjusting levers 16, 26, which serve to independently adjust the inclinations of the recording heads 19, 29, are disposed on board 5 at portions corresponding to accommodating chambers 11, 21, respectively. Angle adjusting levers 16, 26 are described in detail below. Angle adjusting levers 16, 26 are turnably arranged to be operated from the front of carriage main body 1.

In a preferred embodiment, carriage main body 1 includes a nozzle position adjusting lever 35 pivotably mounted on a side wall 4 of main body 1 to permit the position of one of the recording heads, preferably color recording head 29, to be adjusted in a sheet feed direction in relation to the position of the second recording head, preferably black recording head 19. Adjusting lever 35 is pivotably disposed on a side wall 4 on the side of accommodating chamber 21. Main body 1 also includes a sleeve 6 having oil grooves, which accepts a guide rod 2 on which main body 1 is slideably mounted.

These respective position adjusting mechanisms are the features of the invention. The construction of these position adjusting mechanisms will hereunder be described in more detail with reference to FIGS. 2 and 3.

Figure 2:
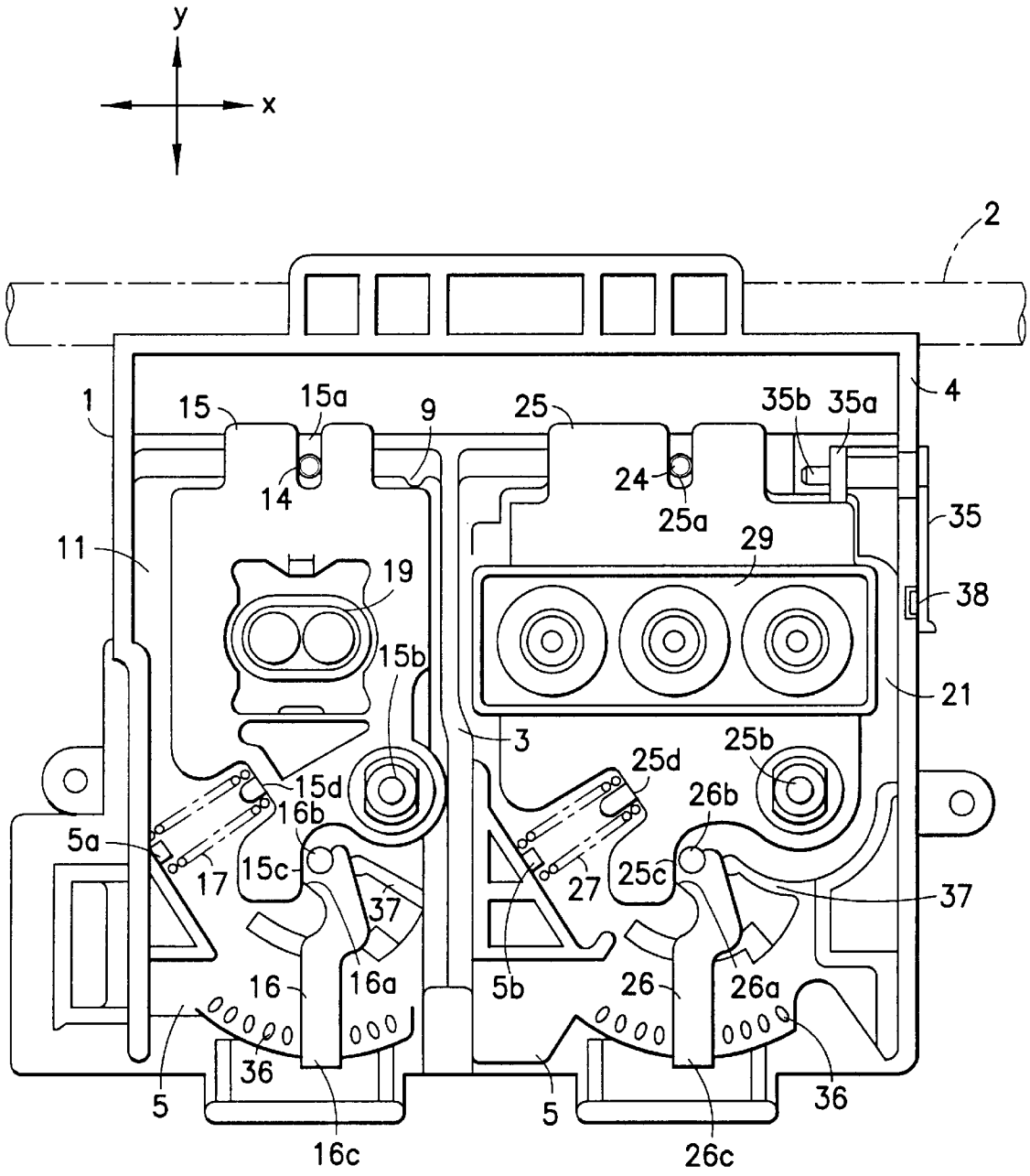
FIG. 2 is a top plan view of the recording head adjustment mechanism constructed in accordance with the invention.

FIG. 2 is a diagram showing carriage main body 1 from above with covers 12, 22 removed. Reference pins 14, 24 are integrally formed at a portion of board 5 of carriage main body 1 closer to guide rod 2 and centered along the width of respective accommodating chambers 11, 21 so as to project therefrom. Plates 15, 25, include respective positioning slits 5*a*, 25*a*, and are disposed within respective chambers 11, 21 to serve as carrying bodies for respectively carrying recording heads 19, 29. Plates 15, 25 are set onto reference pins 14, 24 so that pins 14, 24 are received within slits 15*a*, 25*a* which are pivotable and slidable along pins 14, 24. Further, a projected portion 9 is formed on a portion of board 5 closer to guide rod 2 on the side of black ink cartridge accommodating chamber 11, and is positioned in a Y-axis direction, i.e., substantially perpendicular to guide rod 2 the sheet feet direction, to contact plate 15.

On the other hand, plates 15, 25 are mounted on board 5 so as to be slightly displaced by mounting machine screws 15*b*, 25*b*, which are spaced apart from positioning slits 15*a*, 25*a* Further, contact surfaces 15*c*, 25*c*, which are formed on plates 15 and 25, respectively, are constructed and arranged to contact cam surfaces 16*a*, 26*a* of angle adjusting levers 16, 26, and are arranged on the opposite end of plates 15, 25 from positioning slits 15*a*, 25*a* Contact surfaces 15*c*, 25*c*. are formed on respective plates 15, 25 and arranged substantially orthogonally to guide rod 2. Further, spring receiving seats 15*d*, 25*d*, are disposed on one side of contact surfaces 15*c*, 25*c*, to receive urging forces of springs 17, 27 in an X-axis direction (i.e., substantially parallel to guide rod 2 or a main scanning direction) and in the Y-axis direction, are arranged at an angle of about 45° in relation to guide rod 2.

Spring 17, anchored at its other end by an anchor Sa formed on board 5 urges plate 15 toward reference pin 14 and cam surface 16*a* of angle adjusting lever 16 in the X-axis direction, and toward projected portion 9 on board 5 in the Y-axis direction, respectively. Spring 17 interposed between the spring receiving seat 15*d* and board portion 5*a* formed on board 5. On the other hand, spring 27, anchored between anchor 5*b* formed on board 5 and spring receiving seat 25*d*, urges plate 25 (that carries color recording head 29) toward reference pin 24 and cam surface 26*a* of angle adjusting lever 26 in the X-axis direction and toward an eccentric portion 35*a* of nozzle position adjusting lever 35 in the Y-axis direction, respectively. Nozzle position adjusting lever 35 is described in detail below.

Levers 16, 26 for adjusting the angles of plates 15, 25, respectively are pivotally mounted on pivot pins 16*b*, 26*b*, which protrude from board 5 at locations close to contact surfaces 15*c*, 25*c* of the plates 15, 25. In this manner, levers 16, 26 adjust plates 15, 25 when cam surfaces 16*a*, 26*a*, which are formed at the front ends of levers 16, 26, are caused to urge contact surfaces 15*c*, 25*c* and pivot plates 15, 25 about reference pins 14, 24 by selectively interlocking with the click holes 36. Pressing pieces 37 are formed on board 5 to press cam surfaces 16*a*, 26*a* of levers 16, 26 onto contact surfaces 15*c*, 25*c* of plates 15, 25.

In a preferred embodiment, click holes 36 are arcuately arranged at positions on board 5 and levers 16, 26 include an engagement portion (not shown) formed on the free ends 16*c*, 26*c* of levers 16, 26. In this manner, levers 16, 26 may be fixedly positioned along the arcuately arranged holes 36 at fine graduations when the engagement portions of levers 16, 26 engage click holes 36.

On the other hand, nozzle position adjusting lever 35 is pivotably disposed at a lower portion of side wall 4 of carriage main body 1 on the side of color ink cartridge accommodating chamber 21. As is shown in FIG. 2, a disk 35*a*, the outer circumference of which serves as a cam surface, is eccentrically attached to a support shaft 35*b* of adjusting lever 35. The front end of the plate 25 that carries color recording head 29 is in contact with disk 35*a* at all times by the Y-axis component force of spring 27. Plate 25 is displaceable in the Y-axis direction, substantially orthogonal to the axis of guide rod 2, when disk 35*a* is rotated by turning adjusting lever 35.

In a preferred embodiment, as is shown in FIGS. 1 and 2, click holes 38 are formed in side wall 4 in an arc so that nozzle position adjusting lever 35 may be positioned according to graduations. Nozzle position adjusting lever 35 includes an engagement portion (not shown) formed on free end 35*c* of adjusting lever 35. In this manner, adjusting lever 35 may be fixedly positioned along the arcuately arranged holes 38 at fine graduations when the engagement portions of adjusting lever 35 engages click holes 38.

In such an embodiment, by the urging forces of springs 17, 27, being arranged at an angle of about 45°, plates 15, 25 are positioned and fixed on board 5 of carriage main body 1 with the left side surfaces of positioning slits 15*a*, 25*a* and contact cam surfaces 15*c*, 25*c* brought into contact with reference pins 14, 24 and cam surfaces 16*a*, 26*a* of angle adjusting levers 16, 26 in the X-axis direction, respectively. Further, plate 15 is positioned in contact with projected portion 9 on board 5, in the Y-axis direction by the urging force of spring 17 acting on the surface of spring receiving seat 15*d*. Finally, the front end of plate 25 is positioned in contact with disk 35*a* of nozzle position adjusting lever 35 in the Y-axis direction by the urging force of spring 27 acting on the surface of spring receiving seat 25*d*.

Figure 4:
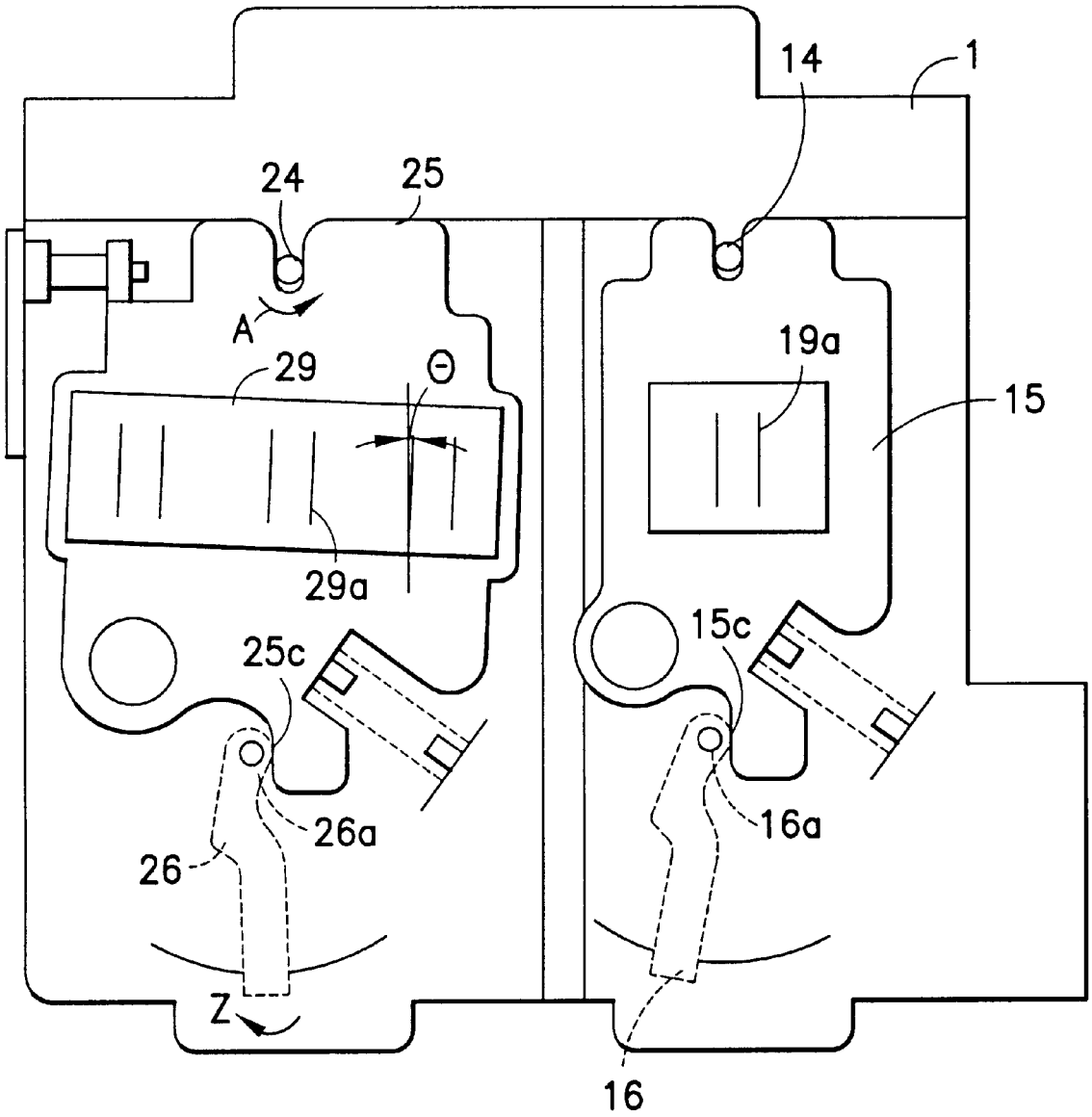
FIG. 4 is a bottom plan view of the head adjustment mechanism constructed in accordance with the invention showing adjustment of the recording head in accordance with the present invention.

As shown in FIG. 4, if the inclination or position of a nozzle array 29*a* arranged on color recording head 29 requires adjustment, angle adjusting lever 26 is turned in an adjusting direction, Z (shown as counterclockwise) by an amount required for adjustment. As a result of this operation, plate 25, which carries recording head 29, pivots about reference pin 24, in the A direction as shown in FIG. 4, when contact surface 25*c* is urged by cam surface 26*a*. That is, nozzle array 29*a* arranged on color recording head 29 is turned through an angle Θ.

Similarly, if the inclination or position of a nozzle array 19*a* arranged on black ink recording head 19 requires adjustment, adjusting lever 16 is turned in an adjusting direction by an amount required for adjustment. As a result, plate 15, which carries recording head 19, pivots about reference pin 14, when contact surface 15*c* is urged by cam surface 16*a*.

Nozzle position adjusting lever 35 disposed on side wall 4 of color ink cartridge 29 of accommodating chamber 21 is operated by turning a required amount so that the positions of the openings of black and color ink nozzles 19*a*, 29*a* coincide with one another in the sheet feed direction. Plate 25, which carries color recording head 29 and whose front end contacts disk 35*a* of lever 35, is displaced by rotation of disk 35*a* in a direction orthogonal to the axis of guide rod 2, i.e., in the Y-axis direction, while guided by reference pin 24 and cam surface 26*a* of angle adjusting lever 26. Preferably, the black ink nozzle openings are positioned based upon the color ink nozzle openings so as to coincide with one another correctly in the sheet feed direction by using black recording head 19 as a reference.

As described in the foregoing, according to the present invention, a recording head carrying body may be adjusted in a scanning direction by turning a first adjustment lever so as to pivot the carrying body about a reference pin arranged on a carriage, and also may be adjusted in a sheet feeding direction by turning a second lever to move the carrying body as the carrying body is guided by the reference pin and a cam portion of the first lever. This arrangement permits the adjustment of one recording head in relation to a second recording head contained on a common carriage.

It is understood that this invention also contemplates applying the above-described mechanisms to more than two recording heads contained in a common carriage.

Further, in one embodiment, one of two carrying bodies is adjusted in the sheet feed direction by a nozzle position adjusting member mounted on a carriage so as to be operable by turning. Therefore, extremely subtle position adjustments, such as adjusting the nozzle position between recording heads, can be made simply and correctly by turning a nozzle position adjusting member while using one of the recording head carrying bodies as a reference It will thus be seen that the objects set forth above, among those made apparent from the preceding description, are efficiently attained and, since certain changes may be made in carrying out the above apparatus without departing from the spirit and scope of the invention, it is intended that all matter contained in the above description shall be interpreted as illustrative and not in a limiting way.

What is claimed is:

1. A head position adjusting mechanism for an ink jet printer, comprising:

a carriage disposed in said ink jet printer, said carriage moveable in a scanning direction;

a plate supported on said carriage, said plate supporting an ink jet head;

a spring member disposed on said carriage to urge said plate against said carriage in said scanning direction and in a sheet feed direction, said sheet feed direction being substantially perpendicular to said scanning direction; and a nozzle position adjusting member pivotably mounted on said carriage for urging said plate along a substantially linear path in said sheet feed direction opposing the urging of said spring member.

2. The head position adjusting mechanism of claim 1, wherein said nozzle position adjusting member comprises a first end, a second end, a shaft attached to said first end extending in a direction parallel to said scanning direction, and a disk attached to said shaft having a cam surface, and wherein said cam surface urges said plate in said sheet feeding direction when said nozzle position adjusting member is rotated.

3. The head position adjusting mechanism of claim 2, wherein said disk is eccentrically mounted on said shaft.

4. The head position adjusting mechanism of claim 2, further comprising a pin formed on said carriage for guiding said plate when said plate is urged in the sheet feeding direction, and a slit formed in said plate for receiving said pin.

5. The head position adjusting mechanism of claim 4, wherein said nozzle position adjusting member includes an engaging portion and said carriage has holes constructed and arranged to accept said engaging portion to selectively position said nozzle position adjusting member at one of a plurality of positions corresponding to graduated amounts of adjustment.

6. The head position adjusting mechanism of claim 5, wherein a pivot point on said nozzle position adjusting member is disposed closer to said first end than to said second end, such that said nozzle position adjusting member acts as a lever.

7. The head position adjusting mechanism of claim 5, wherein at least said first end, said second end and said engaging portion of said nozzle position adjusting member are disposed proximate a side wall of said carriage, said side wall being oriented substantially perpendicular to said scanning direction.

* * * * *